US007002544B2

(12) United States Patent
Sekido

(10) Patent No.: US 7,002,544 B2
(45) Date of Patent: Feb. 21, 2006

(54) LIQUID CRYSTAL DISPLAY APPARATUS OPERATING AT PROPER DATA SUPPLY TIMING

(75) Inventor: Satoshi Sekido, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 506 days.

(21) Appl. No.: 10/097,718

(22) Filed: Mar. 13, 2002

(65) Prior Publication Data

US 2003/0098833 A1 May 29, 2003

(30) Foreign Application Priority Data

Nov. 27, 2001 (JP) ..... 2001-360961

(51) Int. Cl.
*G09G 3/36* (2006.01)

(52) U.S. Cl. ..... 345/98; 345/99; 345/100

(58) Field of Classification Search ..... 345/98–100, 345/204, 213; 349/149–152; 327/91–96
See application file for complete search history.

(56) References Cited

U.S. PATENT DOCUMENTS

| | | | | |
|---|---|---|---|---|
| 6,211,849 | B1 * | 4/2001 | Sasaki et al. | 345/55 |
| 6,456,272 | B1 * | 9/2002 | Howard et al. | 345/107 |
| 6,693,617 | B1 * | 2/2004 | Sasaki et al. | 345/98 |
| 2001/0011987 | A1 * | 8/2001 | Kubota et al. | 345/98 |
| 2002/0003242 | A1 * | 1/2002 | Uchiyama | 257/200 |

FOREIGN PATENT DOCUMENTS

| | | |
|---|---|---|
| JP | 62-269995 | 11/1987 |
| JP | 2000-242241 | 9/2000 |

* cited by examiner

*Primary Examiner*—Kent Chang
(74) *Attorney, Agent, or Firm*—Greer, Burns & Crain, Ltd.

(57) ABSTRACT

A circuit for driving a liquid crystal display panel includes a plurality of output circuits that are coupled to respective data bus lines of the liquid crystal display panel, and output liquid crystal drive signals to the respective data bus lines with respective delays that progressively increase from a first one of the data bus lines to a last one of the data bus lines.

5 Claims, 22 Drawing Sheets

LIQUID CRYSTAL DISPLAY APPARATUS OPERATING AT PROPER DATA SUPPLY TIMING

BACKGROUND OF THE INVENTION

1. Field of the Invention

The present invention relates to a liquid crystal panel drive circuit and a liquid crystal display apparatus.

2. Description of the Related Art

In a liquid crystal display panel, pixels including transistors are arranged in rows and columns, with gate bus lines extending in the horizontal direction being connected to the gates of the pixel transistors, and data bus lines extending in the vertical direction being connected to the pixel capacitors. When data is to be displayed on the liquid crystal display panel, gate drivers drive the gate bus lines one after another to make transistors conductive on a successive line, and the data drivers write the data of one horizontal line to the pixels through the turned-on transistors.

When the gates are driven, the farther away from the gate drivers, the more distorted the gate signal will be because of the resistance and capacitance of the gate bus lines. The signal distortion brings about timing differences between the positions nearer to the gate drivers and the positions farther away from the gate drivers. In detail, the timing at which the gates open is increasingly delayed at the positions further away from the gate drivers compared with the positions nearer to the gate drivers. The timing at which the data drivers output signals for driving the liquid crystal thus needs to be determined by taking into account the gate signal distortion.

Where the timing at which the gates open is delayed at positions far away from the gate drivers due to the gate signal distortion, the data supposed to be written at this pixel position may fail to be written, and the data of next timing (i.e., the data of the next line) may be written at this pixel position. In order to avoid this, the data write timing of the data drivers needs to be controlled such as to match the gate timing at the positions far away from the gate drivers. Such setting, however, ends up reducing the data write timing at the positions nearer to the gate drivers.

As liquid crystal display panels are manufactured with an increasingly fine resolution, the horizontal cycle shortens, resulting in the difficulties in securing a sufficient data write time. Also, as the liquid crystal display panels are manufactured with an increasingly large panel size, the gate bus lines are elongated, thereby making the effect of gate signal distortion increasingly conspicuous. The finer and larger the liquid crystal display panels, therefore, the more difficult it is to secure a sufficient data write time.

Accordingly, there is a need for a liquid crystal display apparatus and drive circuit that can secure a sufficient data write time.

The timing at which the data drivers write data needs to be accurately controlled. This is especially so when the liquid crystal display panels become increasingly finer and larger. Conventionally, the data write time is determined by applying the data tested for a particular liquid crystal display panel to other types of liquid crystal display panels, or is determined by applying the empirical knowledge accumulated over the years to various types of liquid crystal display panels. This may result in a certain type of a liquid crystal display panel suffering a write failure.

Accordingly, there is a need for a liquid crystal display apparatus that can determine the data write time reliably and accurately regardless of the types of liquid crystal display panels and the delay characteristics of gate bus lines.

In order to enlarge the display size under the limitation of a given physical size of a liquid crystal display apparatus, the frame portion surrounding the display portion needs to be reduced in size. In order to achieve this, it is preferable to provide signal lines coupled to the drivers within the liquid crystal display panel (i.e., on the TFT board) rather than on the circuit boards that are conventionally provided in the frame portion. In such a configuration, the drivers are connected in a cascade connection.

Accordingly, there is a need for a configuration having signal lines provided inside the liquid crystal display panel and drivers connected in a cascade connection wherein the data drivers operate at the timing that is properly controlled regardless of differences in the signal propagation lengths and the presence of signal distortion.

SUMMARY OF THE INVENTION

It is a general object of the present invention to provide a liquid crystal display apparatus and associated driver that substantially obviate one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a liquid crystal display apparatus and associated driver particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a circuit for driving a liquid crystal display panel, the circuit including a plurality of output circuits that are coupled to respective data bus lines of the liquid crystal display panel, and output liquid crystal drive signals to the respective data bus lines with respective delays that progressively increase from a first one of the data bus lines to a last one of the data bus lines.

In the circuit described above, the timing at which data drivers output the liquid crystal drive signals is adjusted according to the distances from gate drivers to the respective data bus lines. A constant data write timing is thus achieved regardless of the distances from the gate drivers.

According to another aspect of the present invention, a liquid crystal display apparatus includes a liquid crystal display panel which includes a plurality of data bus lines and a plurality of gate bus lines, a gate driver which drives the plurality of gate bus lines by a gate pulse, a detection circuit which detects a delay of the gate pulse propagating on the gate bus lines and a data driver which delays timing of data pulses for driving the data bus lines in response to the delay detected by the detection circuit.

In the liquid crystal display apparatus as described above, the delay of an actual gate pulse is detected, and the data pulses are delayed according to the detected delay. This makes it possible to set a data write timing reliably and accurately regardless of the types of liquid crystal display panels and/or the delay characteristics of gate bus lines.

According to another aspect of the present invention, a circuit for driving a liquid crystal display panel, which is to be coupled to and supply display data to data bus lines of the liquid crystal display panel, includes input nodes which receive the display data and a clock signal, first output nodes which output the display data to the data bus lines, a synchronizing circuit which synchronizes the display data with the clock signal, and a second output node which supplies the display data synchronized with the clock signal by the synchronizing circuit to a circuit for driving the liquid crystal display panel provided at a next stage.

In the circuit described above, the display data is output to the next stage in synchronization with the clock signal used inside the data driver. This makes it possible to drive data drivers at proper timings regardless of delays and signal distortions that vary depending on the lengths of wires in the panel.

Other objects and further features of the present invention will be apparent from the following detailed description when read in conjunction with the accompanying drawings.

BRIEF DESCRIPTION OF THE DRAWINGS

FIG. 2 is a timing chart for explaining the timing at which the transistors are turned on;

DESCRIPTION OF THE PREFERRED EMBODIMENTS

In the following, embodiments of the present invention will be described with reference to the accompanying drawings.

Figure 1:
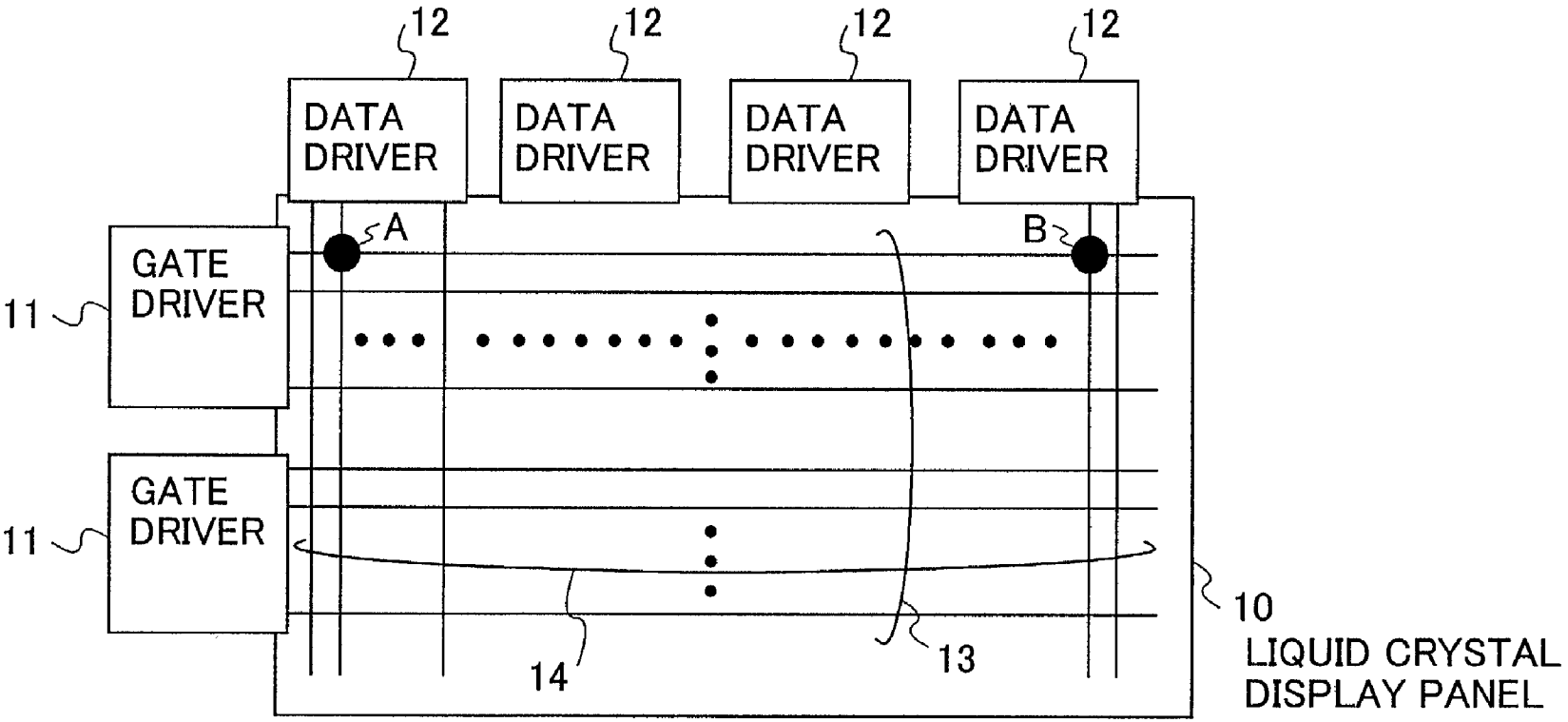
FIG. 1 is a drawing for explaining the principle of the present invention.

FIG. 1 is a drawing for explaining the principle of the present invention.

A liquid crystal display apparatus of FIG. 1 includes a liquid crystal display panel 10, gate drivers 11, data drivers 12, gate bus lines 13, and data bus lines 14. Pixels are situated at the intersections between the gate bus lines 13 and the data bus lines 14. At the position of each pixel, the gate bus lines 13 are coupled to the gates of transistors, and the data bus lines 14 are coupled to pixel condensers via the transistors. When data is to be displayed on the liquid crystal display panel, the gate drivers 11 drives the gate bus lines 13 one after another to make transistors conductive on a successive line, and the data drivers 12 write the data of one horizontal line to pixels through the turned-on transistors.

Figure 2:
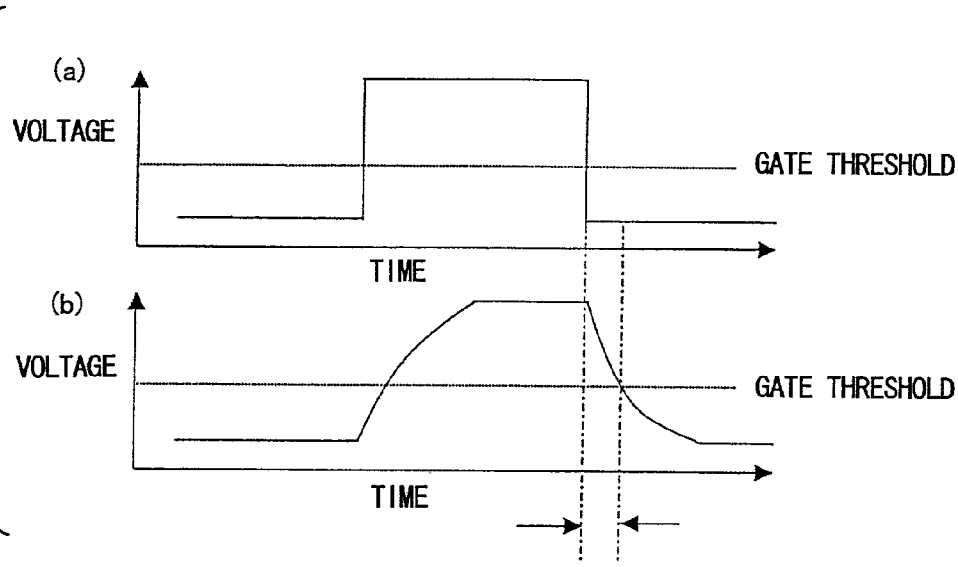

FIG. 2 is a timing chart for explaining the timing at which the transistors are turned on. A letter designation (a) in FIG. 2 shows the potential applied by a gate bus line 13 to a pixel gate at the position A shown in FIG. 1. A letter designation (b) in FIG. 2 shows the potential applied by the gate bus line 13 to a pixel gate at the position B shown in FIG. 1. A transistor stays conductive, i.e., the gate opens, during the time period in which the potential waveform exceeds the threshold of the transistor indicated by the horizontal line. As shown in FIG. 2, the timing at which the gate opens is delayed at the position B farther away from the gate drivers 11 compared with the position A closer to the gate drivers 11. If the data drivers 12 supply data (i.e., voltage signals for driving the liquid crystal) at the timing appropriate for the position B, it will be difficult to secure a sufficient data write time at the position A.

In the present invention, the timing at which the data drivers 12 supply liquid crystal drive voltages is adjusted according to the distances from the gate drivers 11 to the respective data bus lines 14, thereby securing a constant data write time irrespective of the distances from the gate drivers 11.

Figure 3:
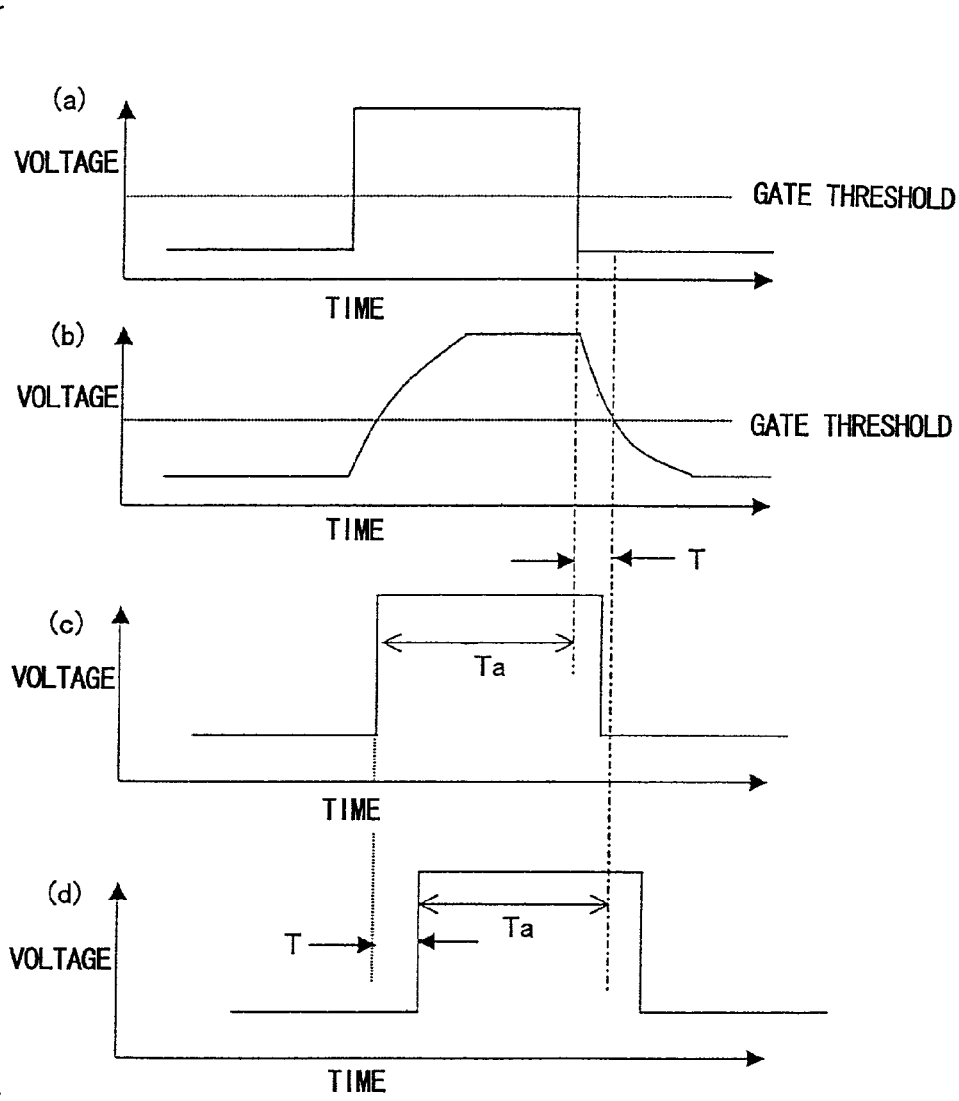
FIG. 3 is a timing chart showing the timing at which the data drivers supply liquid crystal drive voltages.

FIG. 3 is a timing chart showing the timing at which the data drivers supply liquid crystal drive voltages.

A letter designation (a) in FIG. 3 shows the potential applied by a gate bus line 13 to a pixel gate at the position A shown in FIG. 1. A letter designation (b) in FIG. 3 shows the potential applied by the gate bus line 13 to a pixel gate at the position B shown in FIG. 1. A letter designation (c) in FIG. 3 shows the liquid crystal drive voltage supplied by a data driver 12 to a data bus line 14 at the position A shown in FIG. 1. A letter designation (d) in FIG. 3 shows the liquid crystal drive voltage supplied by a data driver 12 to a data bus line 14 at the position B shown in FIG. 1.

As shown in FIGS. 3-(*a*) and (*b*), the period during which the gate is open is delayed by a time delay T at the position B compared with the timing at the position A. In the present invention, the timing at which the data drivers 12 supply the liquid crystal drive voltages is adjusted as shown in FIGS. 3-(*c*) and (*d*), such that the timing of the liquid crystal drive voltage at the position B (FIG. 3-(*d*)) is delayed by the delay T relative to the timing of the liquid crystal drive voltage at the position A (FIG. 3-(*c*)). This makes it possible to secure the constant data write timing regardless of the distances from the gate drivers 11.

Figure 4:
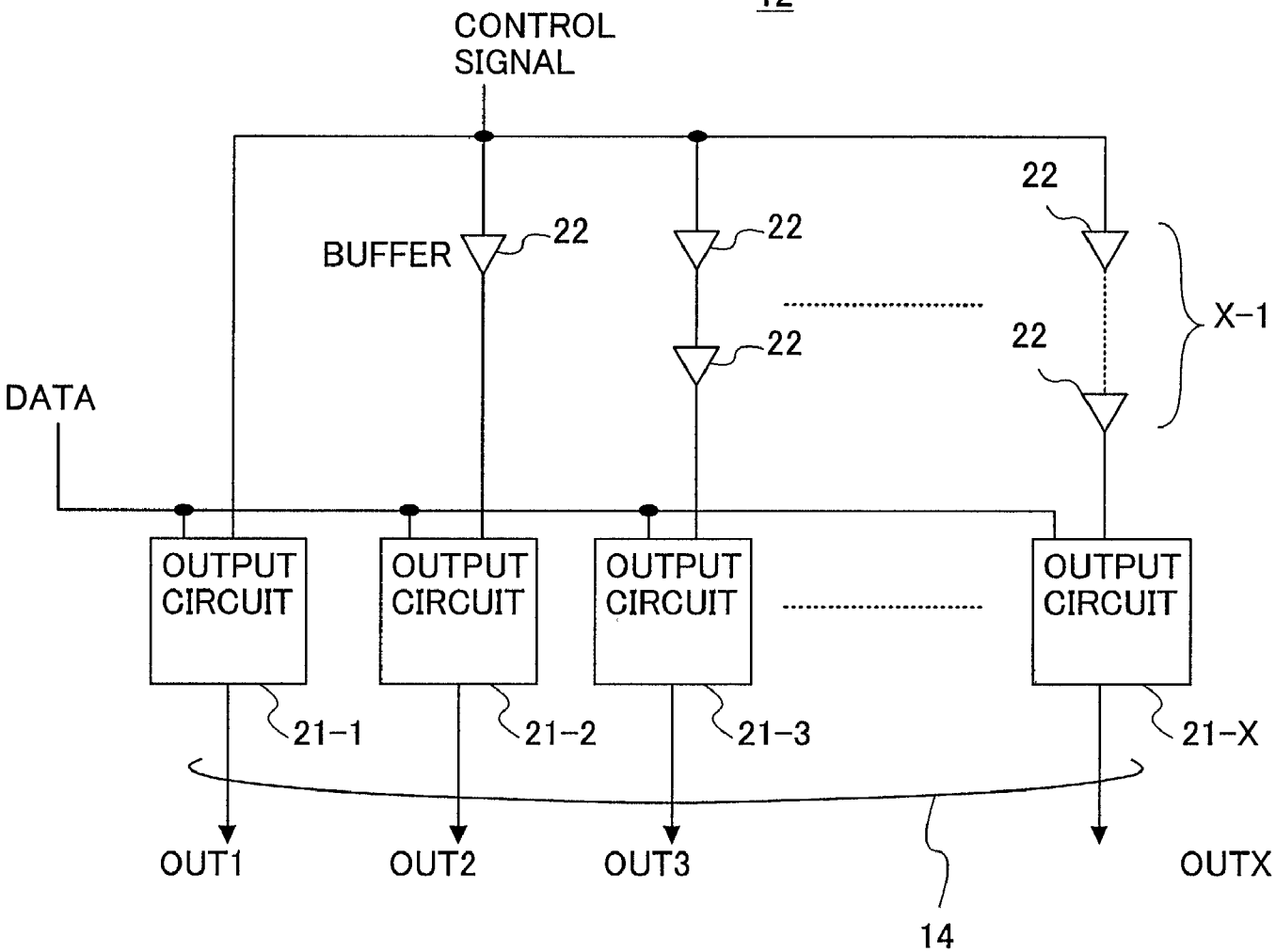
FIG. 4 is a drawing showing a first embodiment of a data driver according to the present invention.

FIG. 4 is a drawing showing a first embodiment of the data driver 12 according to the present invention.

The data driver 12 of FIG. 4 includes X output circuits 21-1 through 21-X and a plurality of buffers (delay elements) 22. Each output circuit receives data and a control signal, and outputs data (i.e., the liquid crystal drive voltage) to a data bus line 14 in accordance with the timing of an arrival of the control signal. At the control signal input of each output circuit, a predetermined number of buffers are provided according to the distances from the gate drivers 11 to the corresponding data bus line 14.

The output circuit 21-1 that corresponds to the data bus line 14 closest to the gate drivers 11 does not have an associated buffer 22, and the output circuit 21-2 that corresponds to the data bus line 14 second closest to the gate drivers 11 has one associated buffer 22. Further, the output circuit 21-3 corresponding to the data bus line 14 third closest to the gate drivers 11 has two associated buffers 22. By the same token, the output circuit 21-X corresponding to the data bus line 14 X-th closest to the gate drivers 11 has X-1 associated buffers 22.

With this provision, the timing at which the data drivers 12 output the liquid crystal drive voltages is adjusted according to the distances from the gate drivers 11 to the respective data bus lines 14. A constant data write timing is thus achieved regardless of the distances from the gate drivers 11.

Figure 5:
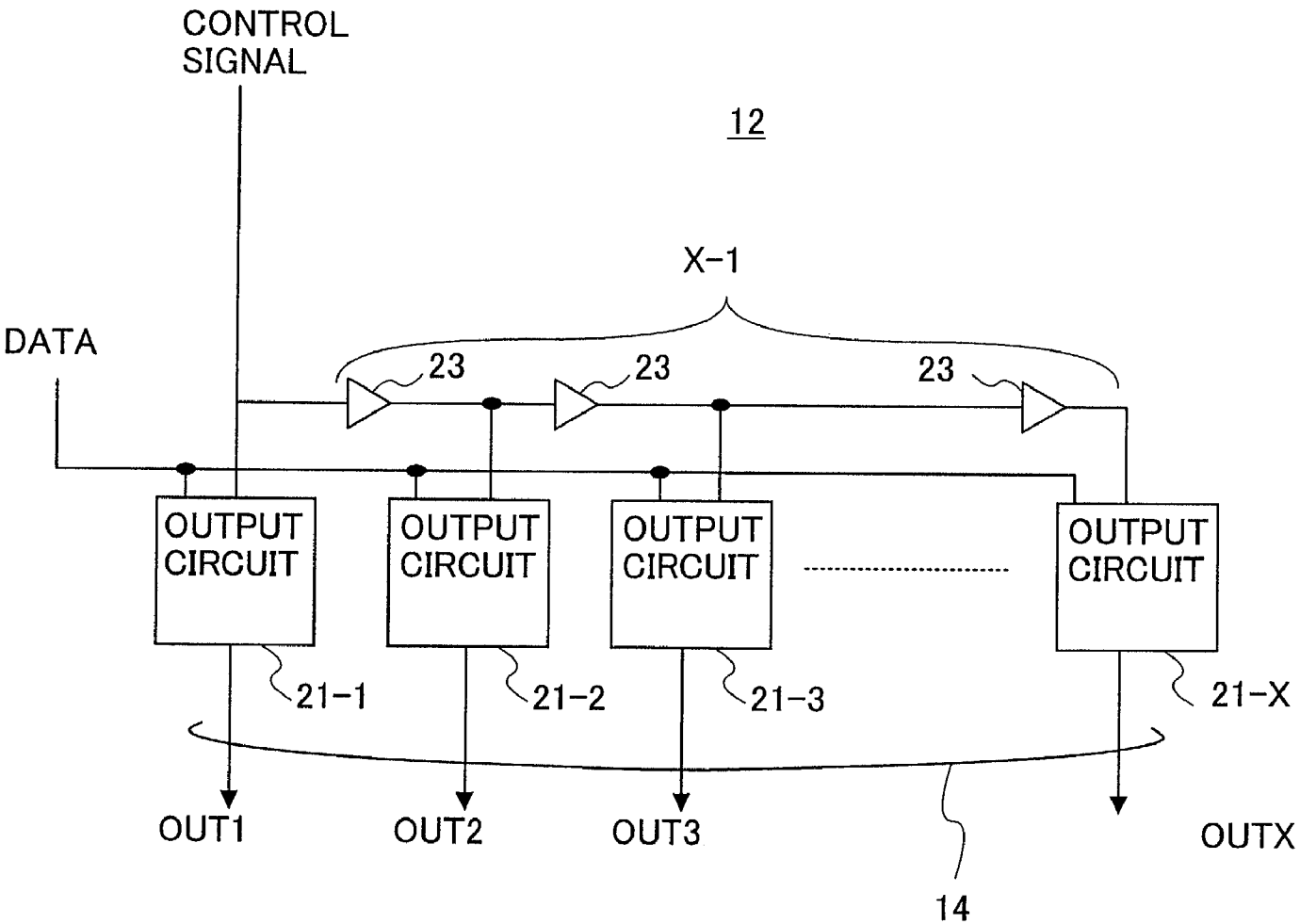
FIG. 5 is a drawing showing a variation of the first embodiment of the data driver.

FIG. 5 is a drawing showing a variation of the first embodiment of the data driver 12 according to the present invention.

In FIG. 5, a plurality (X-1) of buffers (delay elements) 23 are connected in series, and an output of each buffer 23 is coupled to a corresponding one of the output circuits 21-1 through 21-X. With this provision, the timing at which the data drivers 12 output the liquid crystal drive voltages is adjusted according to the distances from the gate drivers 11 to the respective data bus lines 14. A constant data write timing is thus achieved regardless of the distances from the gate drivers 11.

Figure 6:
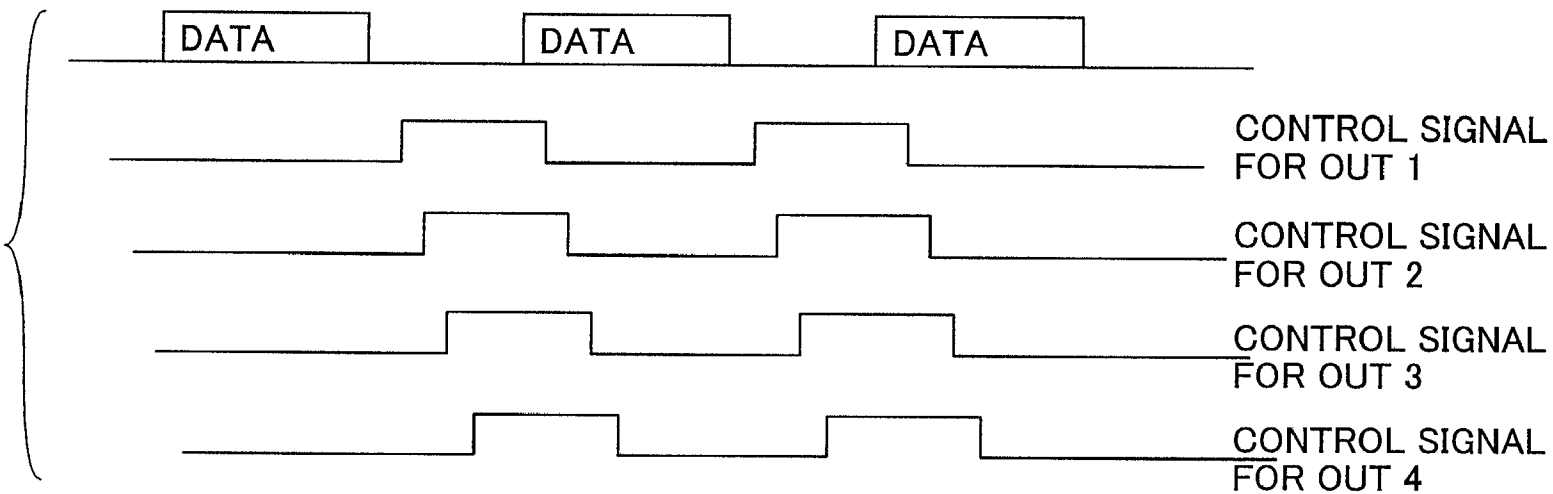
FIG. 6 is a timing chart showing the timings of data and control signals supplied to output circuits of the data driver.

FIG. 6 is a timing chart showing the timings of the data and control signals supplied to the output circuits of the data driver 12. As shown in FIG. 6, the control signals that define the output timing of respective outputs OUT1 through OUTX have delays that are progressively increased. These delays are generated by the buffers 22 of FIG. 4 or the buffers 23 of FIG. 5.

Figure 7:
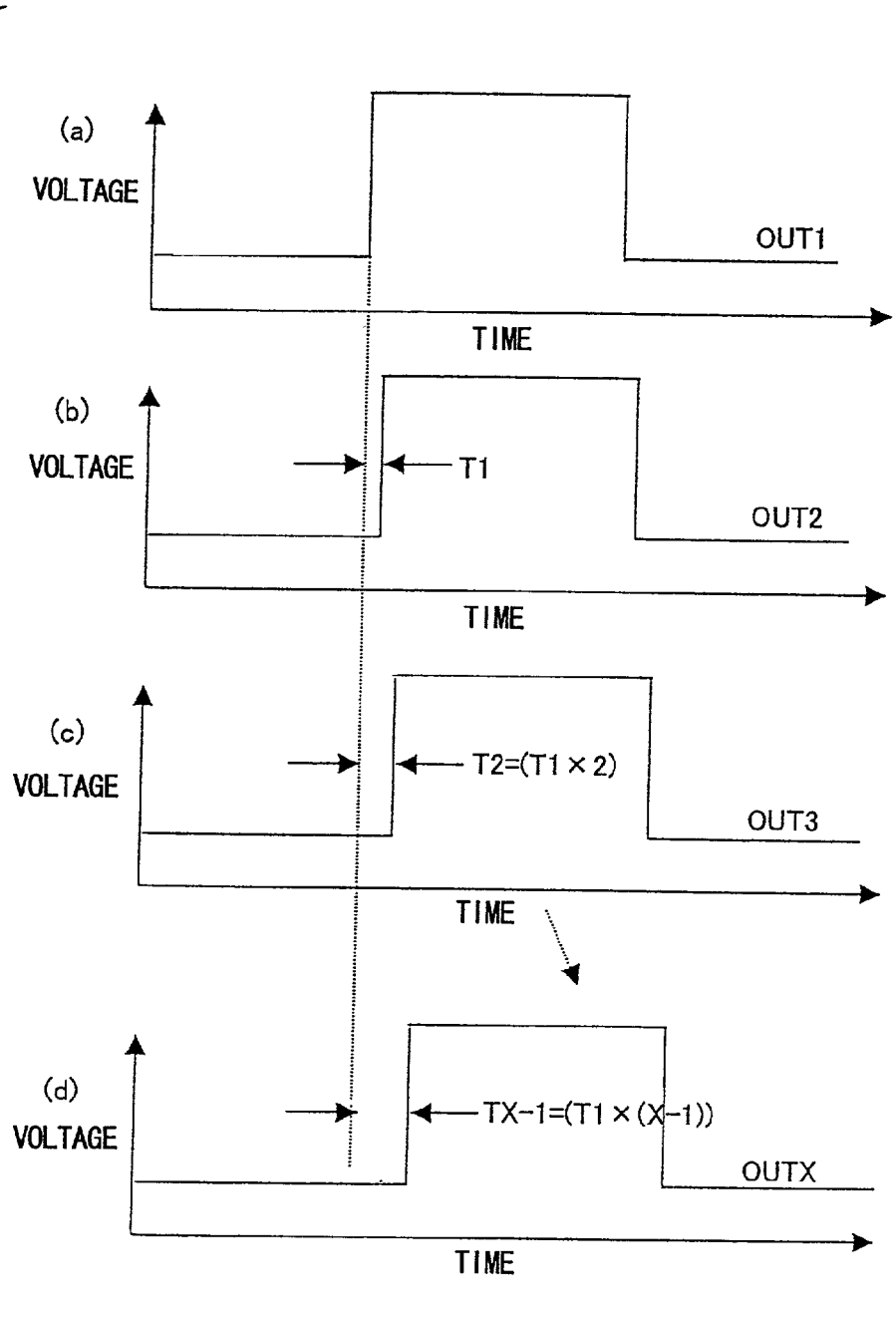
FIG. 7 is a drawing showing output signals of the output circuits of the data driver.

FIG. 7 is a drawing showing output signals of the output circuits of the data driver 12.

Letter designations (a) through (d) in FIG. 7 illustrate the voltage waveforms and timings of respective outputs OUT1, OUT2, OUT3, and OUTX of the output circuits 21-1, 21-2, 21-3, and 21-X. As shown in FIG. 7-(*b*), the output OUT2 is output with a delay T1 relative to the output OUT1. The delay T1 corresponds to the delay of the buffer 22 or the buffer 23. As shown in FIG. 7-(*c*), the output OUT3 is output with a delay 2×T1 relative to the output OUT1. By the same token, as shown in FIG. 7-(*d*), the output OUTX is output with a delay (X-1)×T1 relative to the output OUT1.

Figure 8:
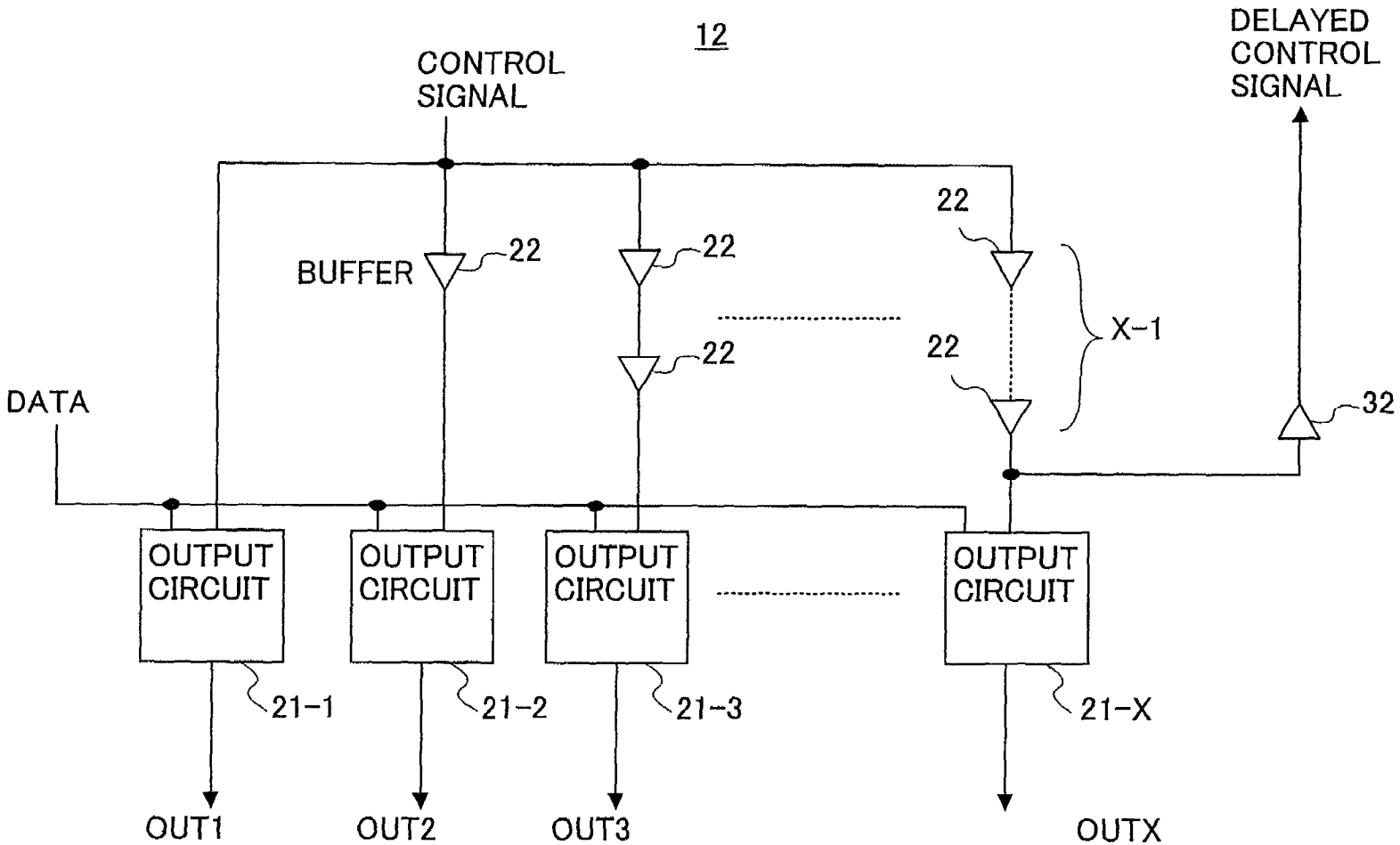
FIG. 8 is drawing showing a second embodiment of the data driver.

FIG. 8 is drawing showing a second embodiment of the data driver 12 according to the present invention. In FIG. 8, the same elements as those of FIG. 4 are referred to by the same numerals, and a description thereof will be omitted.

Figure 10:
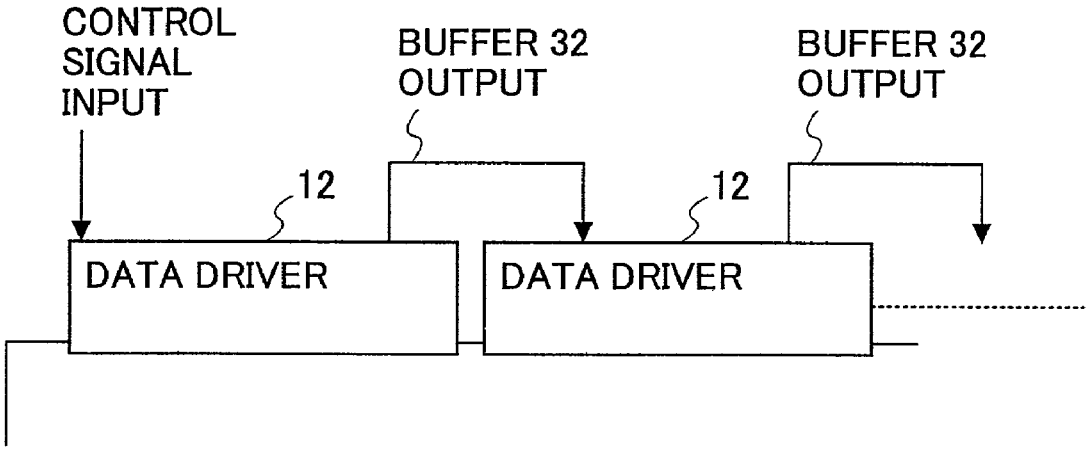
FIG. 10 is a drawing showing a cascade connection of data drivers.

In a liquid crystal display apparatus, generally, a plurality of data drivers 12 are provided for the liquid crystal display panel 10 as shown in FIG. 1, and each of the data drivers 12 is responsible for the writing of data at a corresponding portion of the horizontal line in the liquid crystal display panel 10. In such a configuration, if the timing at which the data drivers 12 supply the liquid crystal drive voltages to the data bus lines 14 is adjusted as in the present invention, it is necessary that the timing be consistent between adjacent data drivers 12. The data driver 12 shown in FIG. 8 is provided with a buffer (delay element) 32 having a delay that corresponds to the delay of a buffer 22, and the output of the buffer 32 is supplied to the exterior of the driver. The output of the buffer 32 is supplied to the data driver 12 situated at the next stage as shown in FIG. 10.

In the configuration of the data driver 12 shown in FIG. 8, the buffer 32 may be provided on the input side where the control signal is received from the preceding stage, rather than on the output side where the signal is supplied to the next stage.

Figure 9:
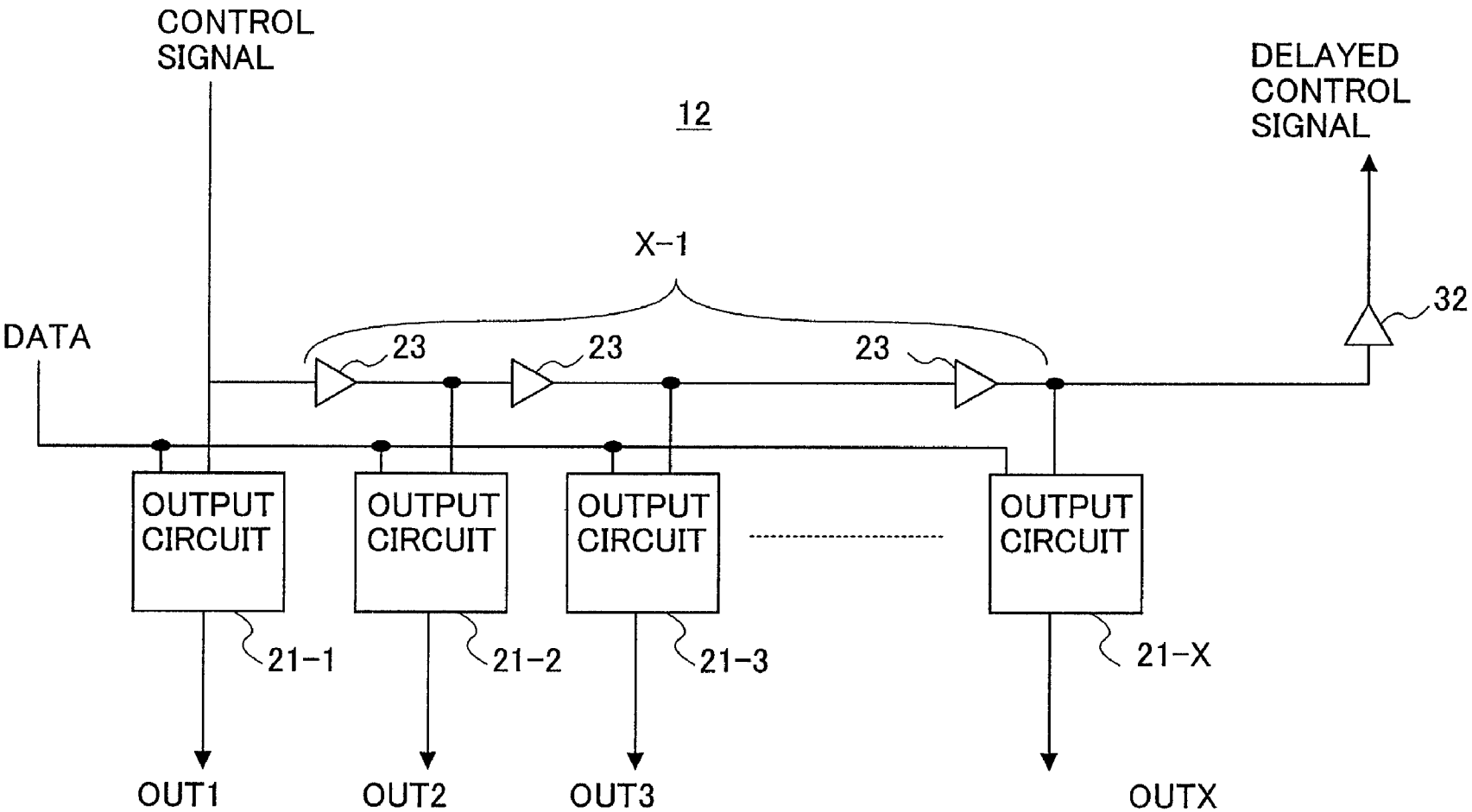
FIG. 9 is a drawing showing a variation of the second embodiment of the data driver.

FIG. 9 is a drawing showing a variation of the second embodiment of the data driver 12 according to the present invention. In FIG. 9, the same elements as those of FIG. 5 are referred to by the same numerals, and a description thereof will be omitted. In FIG. 9, a buffer (delay element) 32 that has a delay corresponding to that of the buffer 23 is newly provided in addition to the configuration of FIG. 5, and the output of the buffer 32 is supplied to the exterior of the driver. The output of the buffer 32 is supplied to the data driver 12 situated at the next stage as shown in FIG. 10. In the configuration of the data driver 12 shown in FIG. 9, the buffer 32 may be provided on the input side where the control signal is received from the preceding stage, rather than on the output side where the signal is supplied to the next stage.

Figure 11:
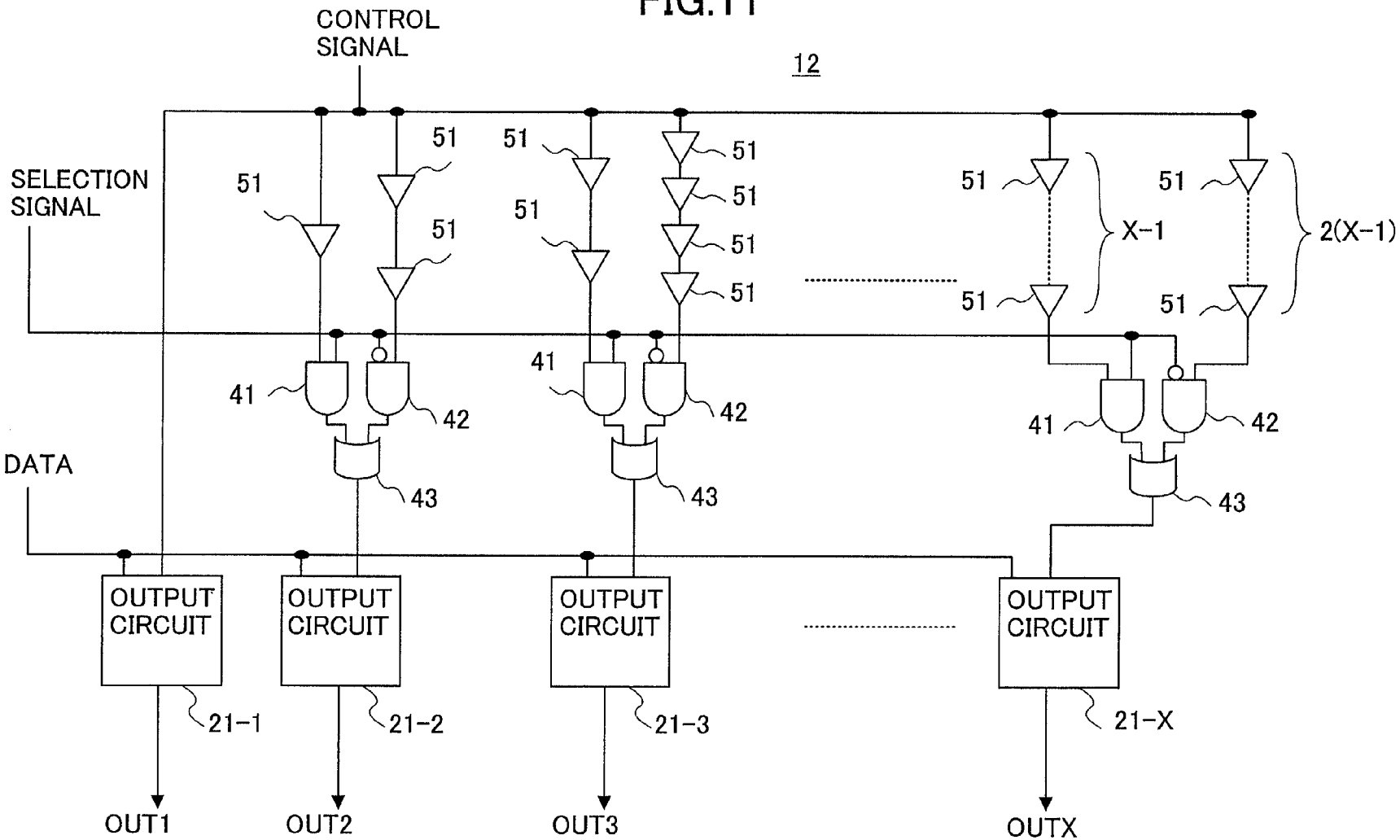
FIG. 11 is a drawing showing a third embodiment of the data driver.

FIG. 11 is a drawing showing a third embodiment of the data driver 12 according to the present invention.

In the data driver 12 of FIG. 11, the output circuits 21-2 through 21-X each have a control signal input thereof coupled to a circuitry that includes a two-input AND circuit 41, a two-input AND circuit 42 having a negative logic input at one input thereof, an OR circuit 43, and a plurality of buffers (delay elements) 51. A selection signal is supplied to one input of the two-input AND circuit 41, and is supplied to the negative logic input of the two-input AND circuit 42.

When the selection signal is HIGH, the control signal supplied through the series of buffers 51 connected to the two-input AND circuit 41 is fed to a corresponding output circuit. When the selection signal is LOW, the control signal supplied through the series of buffers 51 connected to the two-input AND circuit 42 is fed to a corresponding output circuit. The number of buffers 51 connected to the two-input AND circuit 42 is double the number of buffers 51 connected to the two-input AND circuit 41, thereby providing twice as long a delay time. Setting of HIGH/LOW of the selection signal thus controls the delays of the liquid crystal drive voltages (i.e., the outputs OUT1 through OUTX) output from the data driver 12.

Figure 12:
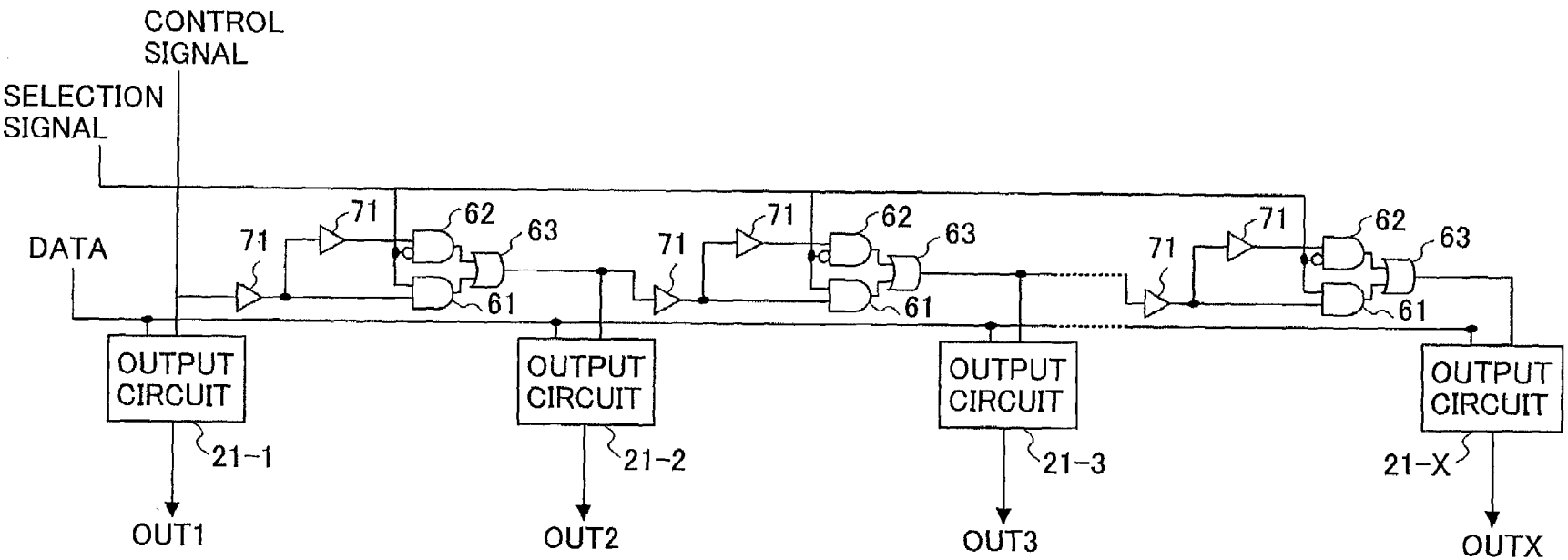
FIG. 12 is a drawing showing a variation of the third embodiment of the data driver.

FIG. 12 is a drawing showing a variation of the third embodiment of the data driver 12 according to the present invention.

In the data driver 12 of FIG. 12, the output circuits 21-2 through 21-X each have a control signal input thereof coupled to a circuitry that includes a two-input AND circuit 61, a two-input AND circuit 62 having a negative logic input at one input thereof, an OR circuit 63, and two buffers (delay elements) 71. A selection signal is supplied to one input of the two-input AND circuit 61, and is supplied to the negative logic input of the two-input AND circuit 62.

When the selection signal is HIGH, the control signal supplied through the series of buffers 71 connected to the two-input AND circuit 61 is fed to a corresponding output circuit. When the selection signal is LOW, the control signal supplied through the series of buffers 71 connected to the two-input AND circuit 62 is fed to a corresponding output circuit. Only one buffer 71 is situated on the signal path coupled to the two-input AND circuit 61, and two buffers 71 are situated on the signal path coupled to the two-input AND circuit 62. With this provision, the selection of the two-input AND circuit 62 will provide twice as long a delay time. In this manner, setting of HIGH/LOW of the selection signal controls the delays of the liquid crystal drive voltages (i.e., the outputs OUT1 through OUTX) output from the data driver 12.

Figure 13:
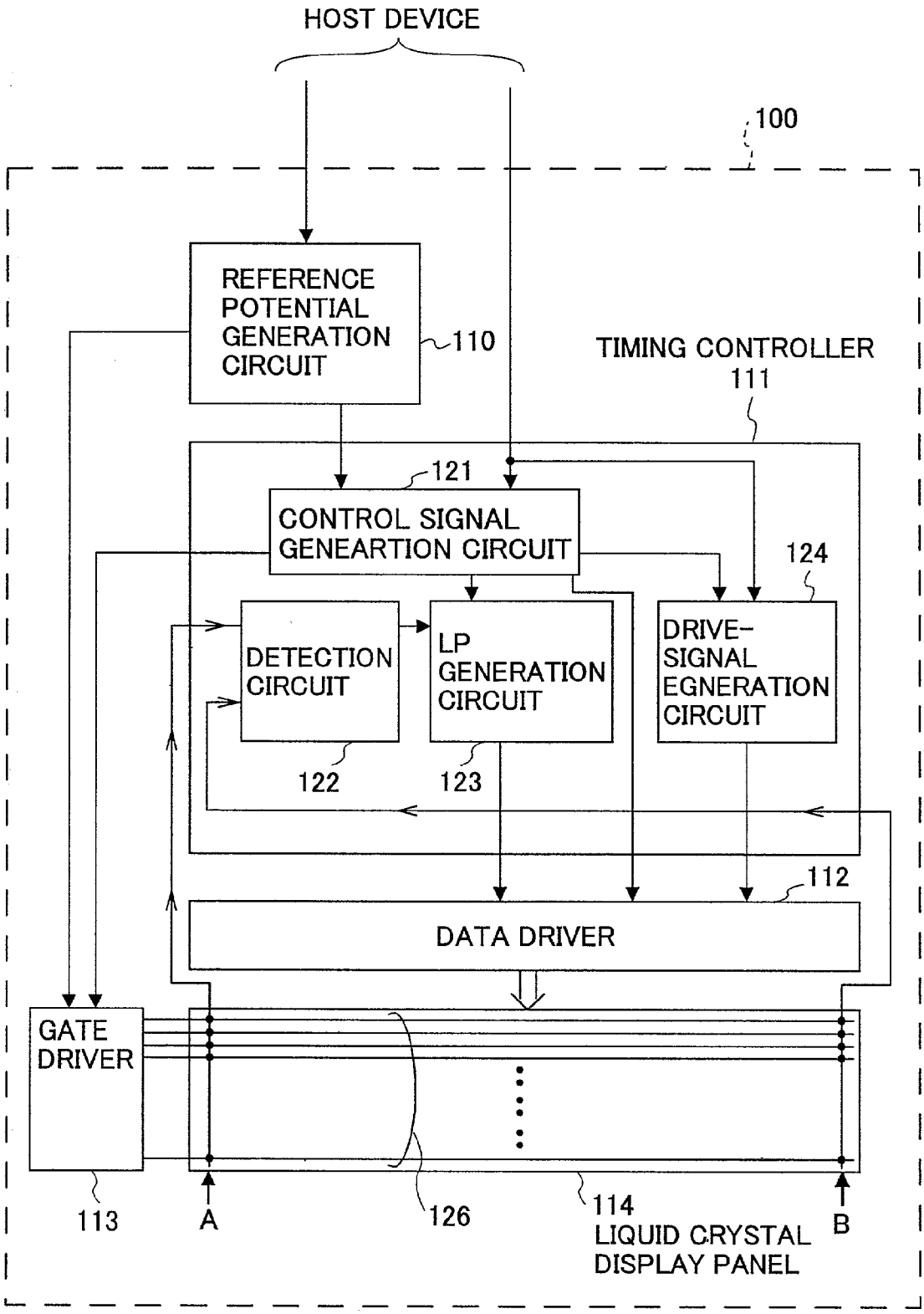
FIG. 13 is a drawing showing an embodiment of a liquid crystal, display apparatus that is provided with a function to set a data write time.

FIG. 13 is a drawing showing an embodiment of a liquid crystal display apparatus that is provided with a function to set a data write time.

A liquid crystal display apparatus 100 of FIG. 13 includes a reference potential generation circuit 110, a timing controller 111, a data driver 112, a gate driver 113, and a liquid crystal display panel 114. The liquid crystal display apparatus 100 receives display data signals, a clock signal, and control signals such as an enable signal from the host device, and operates based on these signals. The reference potential generation circuit 110 generates reference potentials, and supplies them to the timing controller 111 and the gate driver 113. Based on the signals supplied from the host device, the timing controller 111 generates control signals and timing signals for driving the data driver 112 and the gate driver 113, and supplies the generated signals to the data driver 112 and the gate driver 113. The gate driver 113 drives the gate bus lines of the liquid crystal display panel 114 by gate pulses. The data driver 112 drives the data bus lines of the liquid crystal display panel 114 by data pulses.

The timing controller 111 includes a control signal generation circuit 121, a detection circuit 122, an LP generation circuit 123, and a drive-signal generation circuit 124. The control signal generation circuit 121 generates various control signals including the control signals and timing signals for driving the data driver 112 and the gate driver 113. The detection circuit 122 detects delays of the gate pulses on the gate bus lines of the liquid crystal display panel 114. The detected delays of the gate pulses are reported to the LP generation circuit 123. The LP generation circuit 123 generates a latch pulse LP that triggers the transfer of display data to output-purpose D/A converters inside the data driver 112. The drive-signal generation circuit 124 supplies the display data to the data driver 112 at proper timing, so that the data driver 112 writes the display data in the liquid crystal display panel 114.

The detection circuit 122 receives the gate pulses from the gate bus lines 126 of the liquid crystal display panel 114, i.e., receives one gate pulse from the position A nearest to the gate driver 113 and another gate pulse from the position B farthest away from the gate driver 113. The detection circuit 122 generates a pulse signal indicative of a time difference of the two pulses, i.e., the delay of the gate pulse, and supplies the generated pulse signal to the LP generation circuit 123. The LP generation circuit 123 generates the latch pulse LP that determines the output timing of analog data signals supplied from the data driver 112 to the liquid crystal display panel 114. The timing of this latch pulse LP is delayed by a length of the pulse signal supplied from the detection circuit 122. This makes it possible to delay the timing of the data pulses that are write data signals output from the data driver 112 according to the delay of gate pulses.

Figure 14:
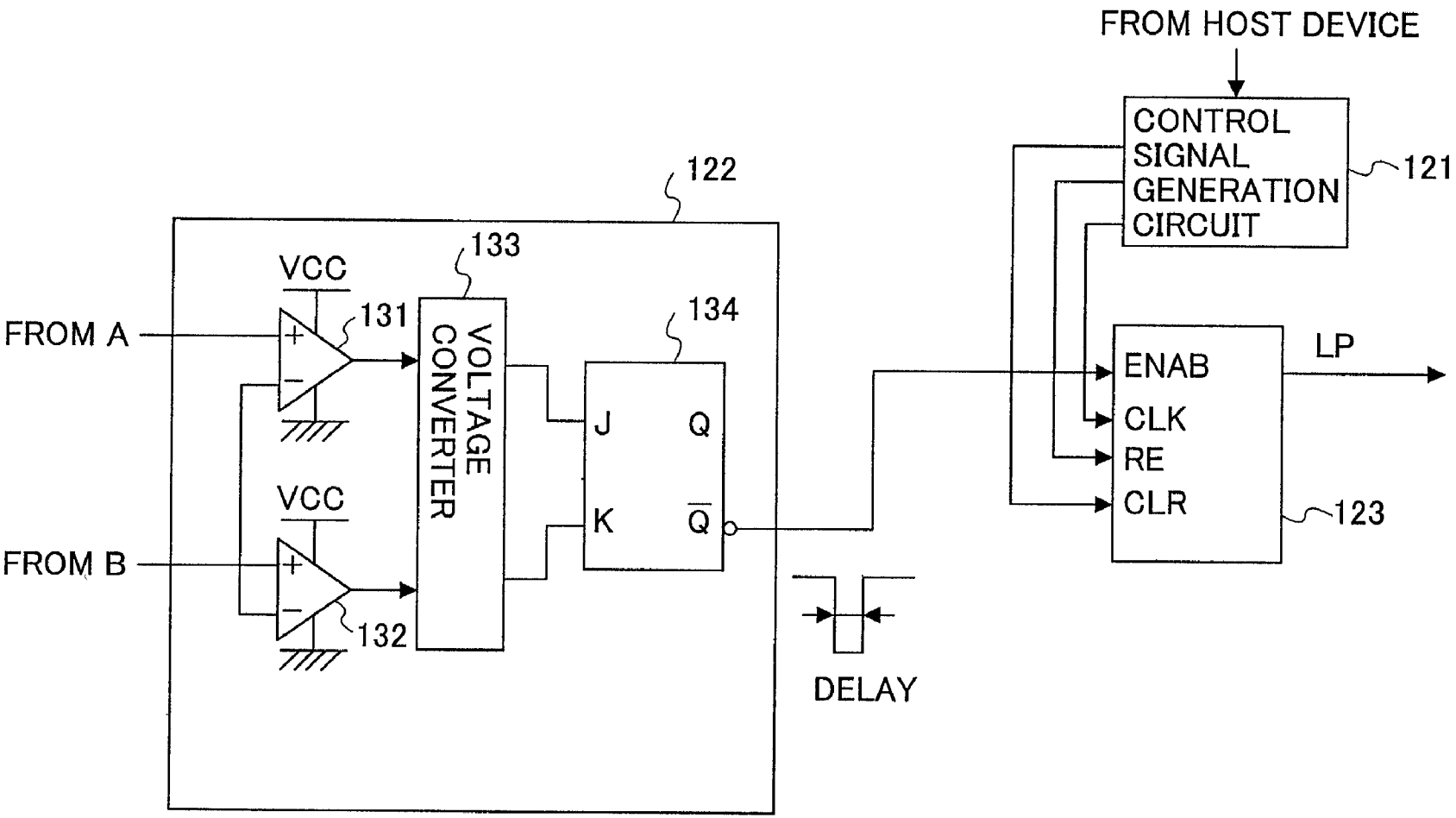
FIG. 14 is a circuit diagram showing a configuration of a detection circuit.

FIG. 14 is a circuit diagram showing a configuration of the detection circuit 122.

The detection circuit 122 includes comparators 131 and 132, a voltage converter 133, and a JK flip-flop 134. The comparators 131 and 132 receive the respective analog pulse signals from the position A and position B of the gate bus line 126, and convert them to digital signals. The converted digital signals are further converted by the voltage converter 133 into voltage signals that are suitable for the JK flip-flop 134. The JK flip-flop 134 is set at the rising edge of a pulse of the position A, and is reset at the rising edge of a pulse of the position B. Accordingly, the JK flip-flop 134 outputs a pulse signal that has a pulse width equal to the time difference between the position-A pulse and the position-B pulse, i.e., a pulse width equal to the delay along the gate bus line.

The negative logic output of the JK flip-flop 134 that remains at LOW for duration equal to the delay along the gate bus line is coupled to the enable input ENAB of the LP generation circuit 123. The clock input CLK of the LP generation circuit 123 receives a clock signal from the control signal generation circuit 121. Further, the reset input RE of the LP generation circuit 123 receives a pulse signal (reference pulse) from the control signal generation circuit 121 that indicates the start of each horizontal period. The clear input CLR is normally set to LOW.

The LP generation circuit 123 is a counter circuit implemented as an ASIC or the like, and is conventionally used in liquid crystal display apparatuses. The LP generation circuit 123 counts the number of pulses of the clock signal that is supplied to the clock input CLK, and outputs the latch pulse LP at the predetermined count. When the reset input RE is asserted, the count is reset. In the present invention, the enable input ENAB of this circuit is utilized for the purpose of delaying the timing of the latch pulse LP that is output from the circuit. During the LOW state of the enable input ENAB, the clock signal supplied to the clock input CLK is not counted. Accordingly, the provision of a LOW pulse to the enable input ENAB stops the counting operation for the duration equal to the LOW period of this pulse signal, thereby delaying the output timing of the latch pulse LP by a delay corresponding to the pulse width.

Figure 15:
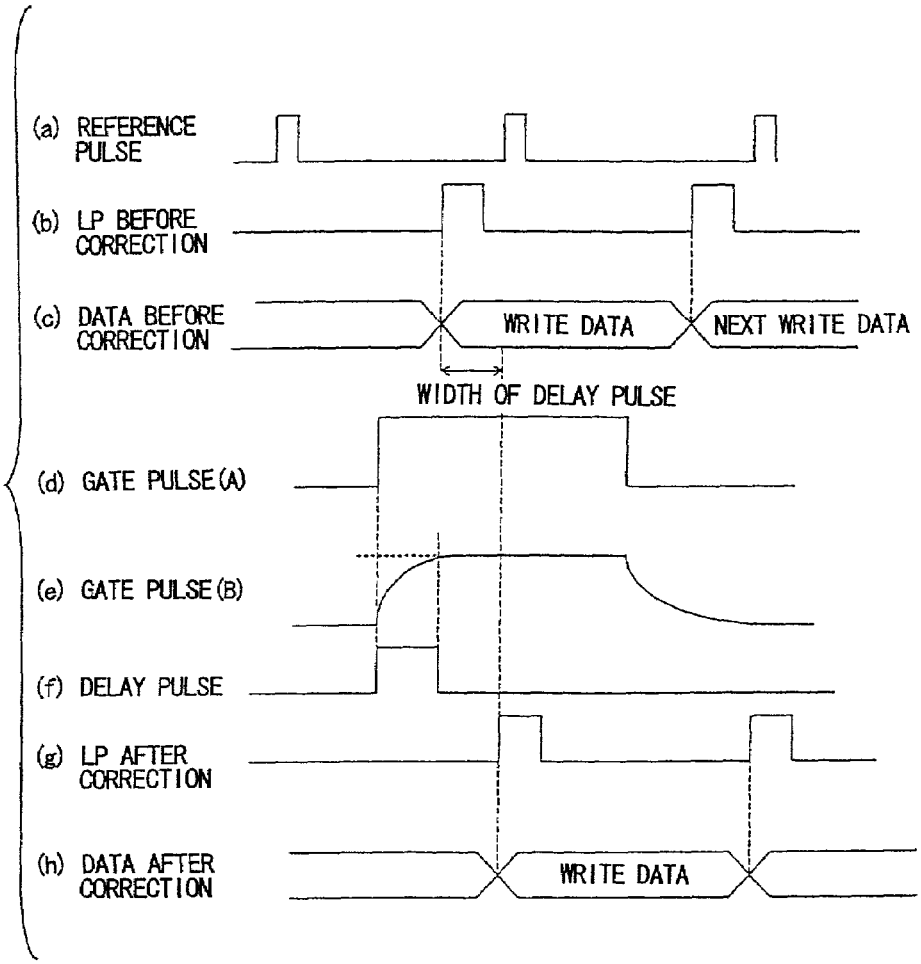
FIG. 15 is a timing chart for explaining an operation that sets a data write time in the configuration shown in FIG. 13 and FIG. 14.

FIG. 15 is a timing chart for explaining the operation that sets a data write time in the configuration shown in FIG. 13 and FIG. 14.

A letter designation (a) in FIG. 15 shows a reference pulse that is supplied to the reset input RE of the LP generation circuit 123. A letter designation (b) exhibits the latch pulse LP as observed in the absence of timing correction of the present invention. At the timing indicated by this latch pulse LP, the data driver 112 outputs write data signals as illustrated as a letter designation (c). The data signal shown in (c) is illustrated with the timing that is not corrected by the correction of the present invention.

A letter designation (d) shows a gate pulse waveform observed at the position A of FIG. 13. A letter designation (e) shows a gate pulse waveform that is distorted as observed at the position B of FIG. 13. The falling edge of the gate pulse at the position B is substantially delayed behind the falling edge of the gate pulse appearing at the position A. At the position B, therefore, there is a risk of writing the next write data NEXT rather than writing correct write data if the data of no timing correction as shown in (c) is used.

In the present invention, the detection circuit 122 detects the time difference between the rising edge of the gate pulse observed at the position A (FIG. 15-(*d*)) and the rising edge of the gate pulse observed at the position B (FIG. 15-(*e*)), and outputs a delay pulse indicative of this time difference as shown in (f). The LP generation circuit 123 delays the generation timing of the latch pulse LP by the pulse width of this delay pulse, thereby generating the timing-corrected latch pulse LP as shown in (g). At the timing indicated by this latch pulse LP, the data driver 112 outputs write data signals as shown in (h). The data signal shown in (h) has the timing that is corrected according to the present invention.

The timing of the write data illustrated in FIG. 15-(*h*) is delayed by the pulse width of the delay pulse relative to the timing of the write data subjected to no timing correction as shown in (c). As a result, even though the gate pulse has a waveform as shown in (d) at the position A and a distorted waveform as shown in (e) at the position B, correct write data can be written properly at both the position A and the position B. Namely, proper data writing is achieved at all the positions from the position A to the position B.

In this manner, the function of setting a data write time according to the present invention detects the delay of an actual gate pulse, and delays the data pulses according to the detected delay. This makes it possible to set a data write timing reliably and accurately regardless of the types of liquid crystal display panels and/or the delay characteristics of gate bus lines.

In the following, another aspect of the present invention will be described.

There is a demand for an increase in the display volume and display size whereas there is also a demand for compact computer monitors. In a liquid crystal display apparatus, a TFT board and a common board facing each other are stuck together, with liquid crystal placed therebetween. The liquid crystal allows the passage of light that corresponds in amount to the voltage differences between the TFT board electrodes and the common board electrodes, thereby achieving the presentation of gray scale levels by use of different voltages. In order to apply voltage differences and to have the pixels hold the respective voltages, the TFT board has source-side driver ICs (i.e., data drivers) and gate-side driver ICs (i.e., gate drivers) electrically connected thereto. The frame portion of a liquid crystal display apparatus needs to accommodate electrical connections for the source-side drivers and the gate-side drivers, and these driver ICs need a printed-circuit board, a flexible circuit board, or the like for the purpose of supplying control signals.

Figure 16:
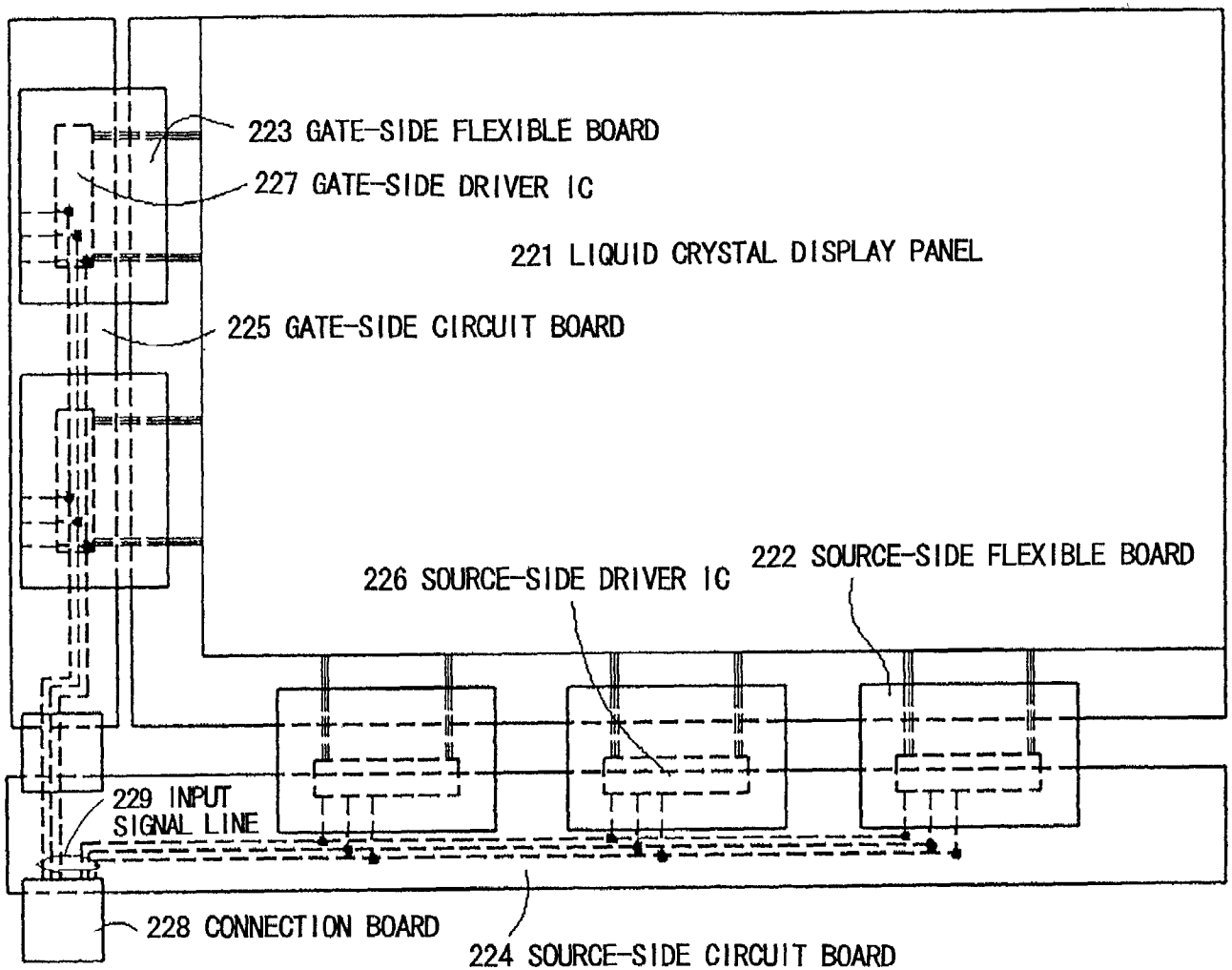
FIG. 16 is a drawing showing a configuration of a related-art liquid crystal display apparatus.

FIG. 16 is a drawing showing a configuration of a related-art liquid crystal display apparatus.

The related-art liquid crystal display apparatus of FIG. 16 includes a liquid crystal display panel 221, source-side flexible boards 222, gate-side flexible boards 223, a source-side circuit board 224, a gate-side circuit board 225, source-side driver ICs 226, gate-side driver ICs 227, a connection board 228, and input signal lines 229. As shown in FIG. 16, the liquid crystal display apparatus of the related-art configuration provides the source-side circuit board 224 and the gate-side circuit board 225 around the liquid crystal display panel 221, and lays out the input signal lines 229 on the circuit boards.

In order to enlarge the display size within the limited physical size of the monitor apparatus, the frame portion surrounding the display portion needs to be reduced in size. To this end, the input signal lines 229 coupled to the drivers (driver ICs) may be provided directly on the TFT board rather than on the circuit boards that are provided in the frame portion as shown in FIG. 16. Such configuration is becoming more widely used.

Figure 17:
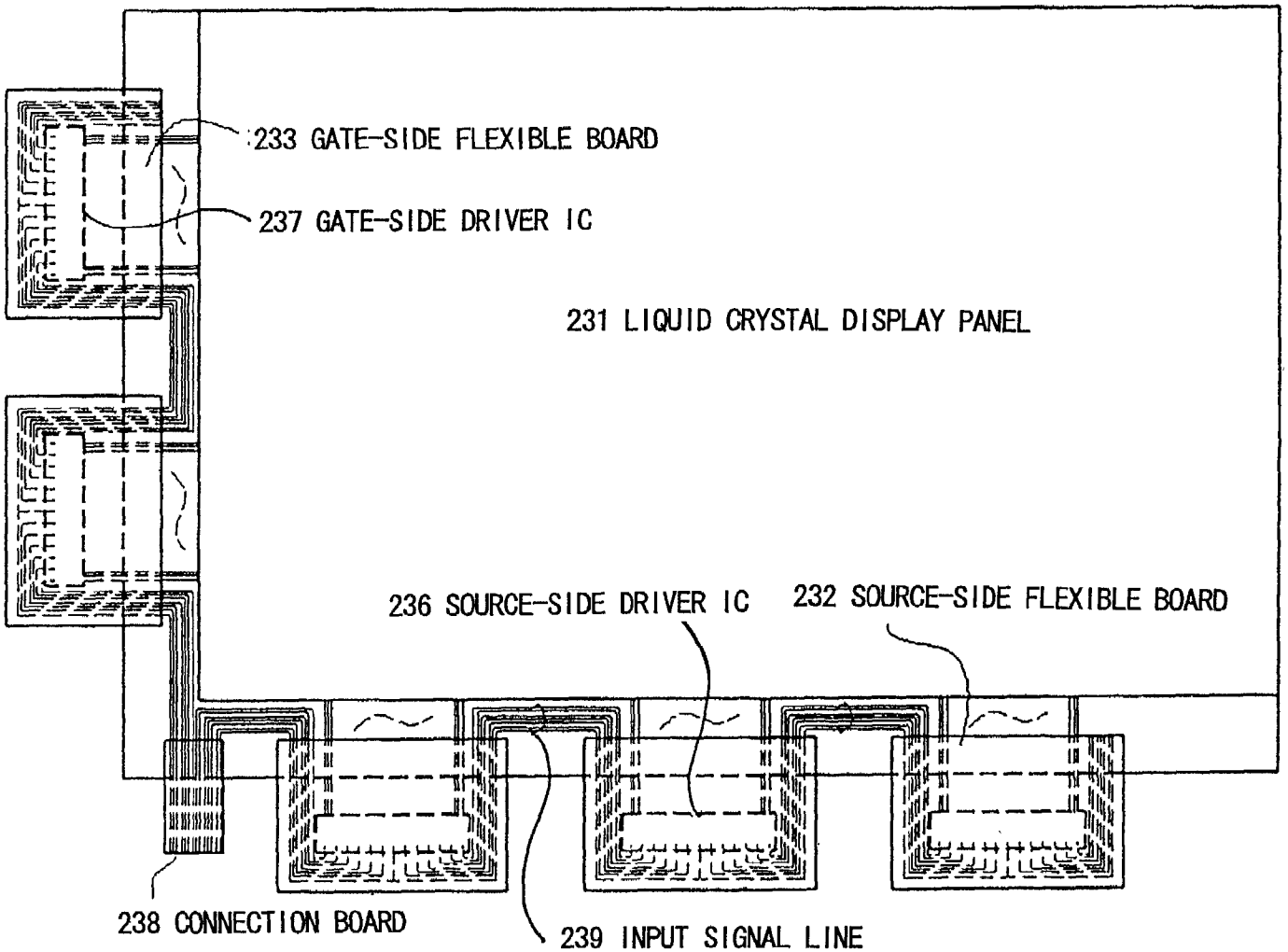
FIG. 17 is a drawing showing a configuration in which input signal lines are provided on the TFT board.

FIG. 17 is a drawing showing a configuration in which input signal lines are provided on the TFT board.

The liquid crystal display apparatus of FIG. 17 includes a liquid crystal display panel 231, source-side flexible boards 232, gate-side flexible boards 233, source-side driver ICs 236, gate-side driver ICs 237, a connection board 238, and input signal lines 239. As shown in FIG. 17, the drivers (driver ICs) receive input signals, and supply the output signals to the liquid crystal display panel 231, further outputting signals to the next stage for the purpose of driving the drivers in a cascade connection. Where the input signal lines 239 are provided on the TFT board as shown in FIG. 17, however, the distortion and/or delay of data signals and clock signals may be observed. That is, signals input to the drivers do not have delays nor signal distortion near the position where the signals originate, but will suffer increasing delays and distortion because of wire resistance and parasitic capacitance as the signals propagate farther away from the originating position.

As a countermeasure, a design may be made such as to reduce the wire resistance inside the panel, or the timing of signals may be adjusted by taking into account the delay. As the display panel increases in size and resolution, however, the time difference between the point closer to the signal origin and the point farther away from the signal origin widens, thereby making it difficult to take proper measures.

In the following, a data driver that obviates the above-described problem of wire delays will be described.

Figure 18:
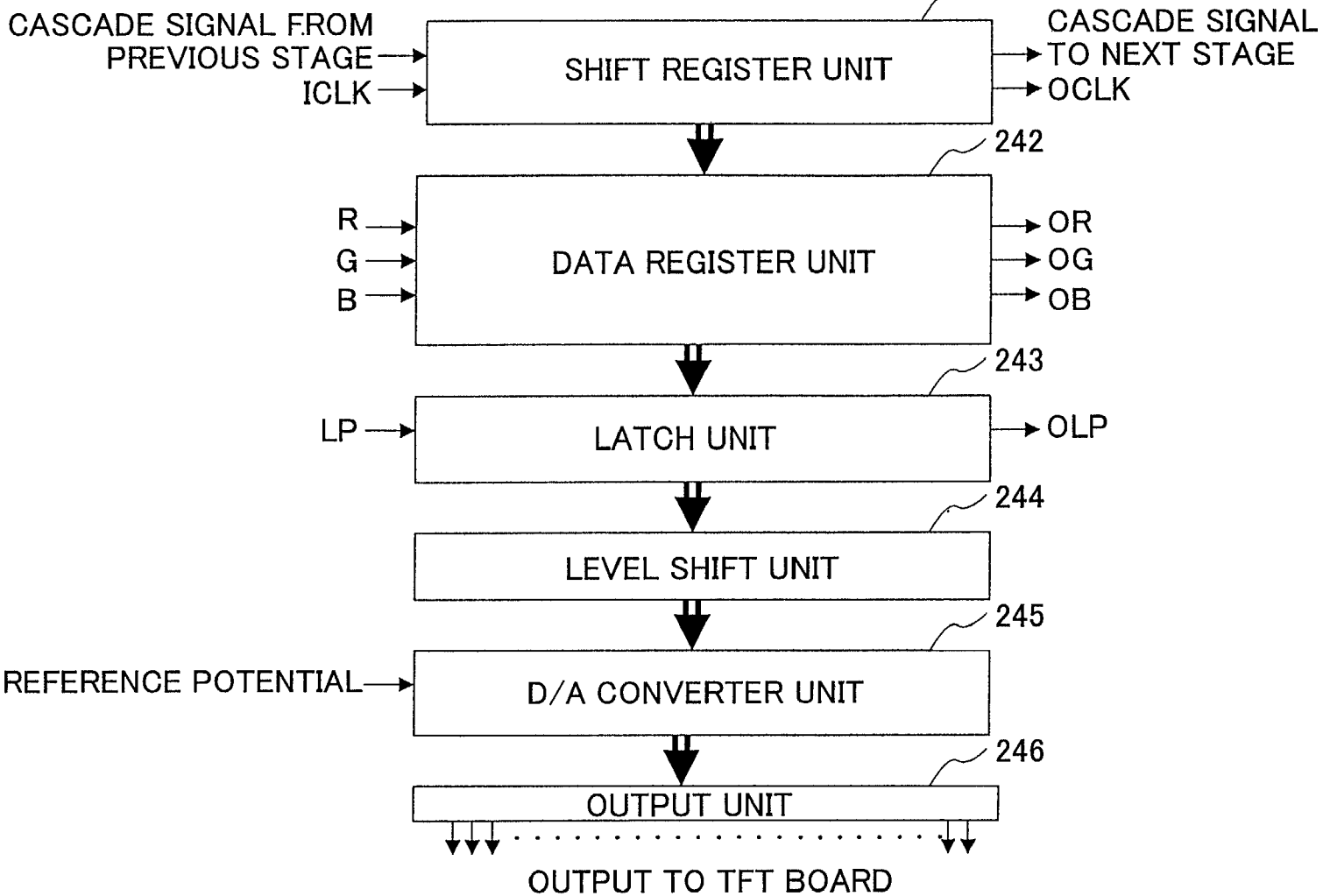
FIG. 18 is a drawing showing a configuration of a data driver.

FIG. 18 is a drawing showing a configuration of a data driver according to the present invention.

The data driver of FIG. 18 includes a shift register unit 241, a data register unit 242, a latch unit 243, a level shift unit 244, a D/A converter unit 245, and an output unit 246.

The shift register unit 241 asserts a plurality of output signal lines one after another in synchronization with the data clock signal ICLK supplied from a host device such as a personal computer, a control device, or the like, thereby supplying data latch signals to the data register unit 242. The data register unit 242 stores the RGB display data in its internal register circuits in response to the data latch signals as the RGB display data are successively supplied. In this manner, the data register unit 242 stores therein the display data that corresponds to its associated portion of the entire display line (i.e., a gate bus line). The display data stored in the data register unit 242 is latched by the latch unit 243 in synchronization with the latch pulse LP.

The display data stored in the latch unit 243 is supplied to the D/A converter unit 245 through the level shift unit 244. The D/A converter unit 245 includes D/A conversion circuits corresponding to respective data lines, and these D/A conversion circuits convert the display data from digital to analog, thereby outputting analog gray-scale signals. The D/A converter unit 245 receives a set of reference potentials. Each D/A conversion circuit divides potentials of the set of reference potentials to generate a potential corresponding to the associated gray scale, followed by outputting an analog gray-scale signal having a potential corresponding to the supplied digital display data.

The output unit 246 includes output buffers provided for the respective data lines, and each output buffer receives a corresponding analog gray-scale signal from the D/A converter unit 245. Each output buffer supplies the received analog gray-scale signal to the TFT board as a data bus line drive signal for driving a corresponding data bus line.

In the data driver of the present invention, the display data RGB fed to the data register unit 242 are supplied to the next stage as display data OR, OG, and OB in synchronization with an output clock signal OCLK that is supplied from the shift register unit 241 to the next stage. Further, the cascade signal that is supplied to the next stage is output from the shift register unit 241 in synchronization with the output clock OCLK. This cascade signal indicates the start of data that is relevant to the recipient data driver.

Figure 19:
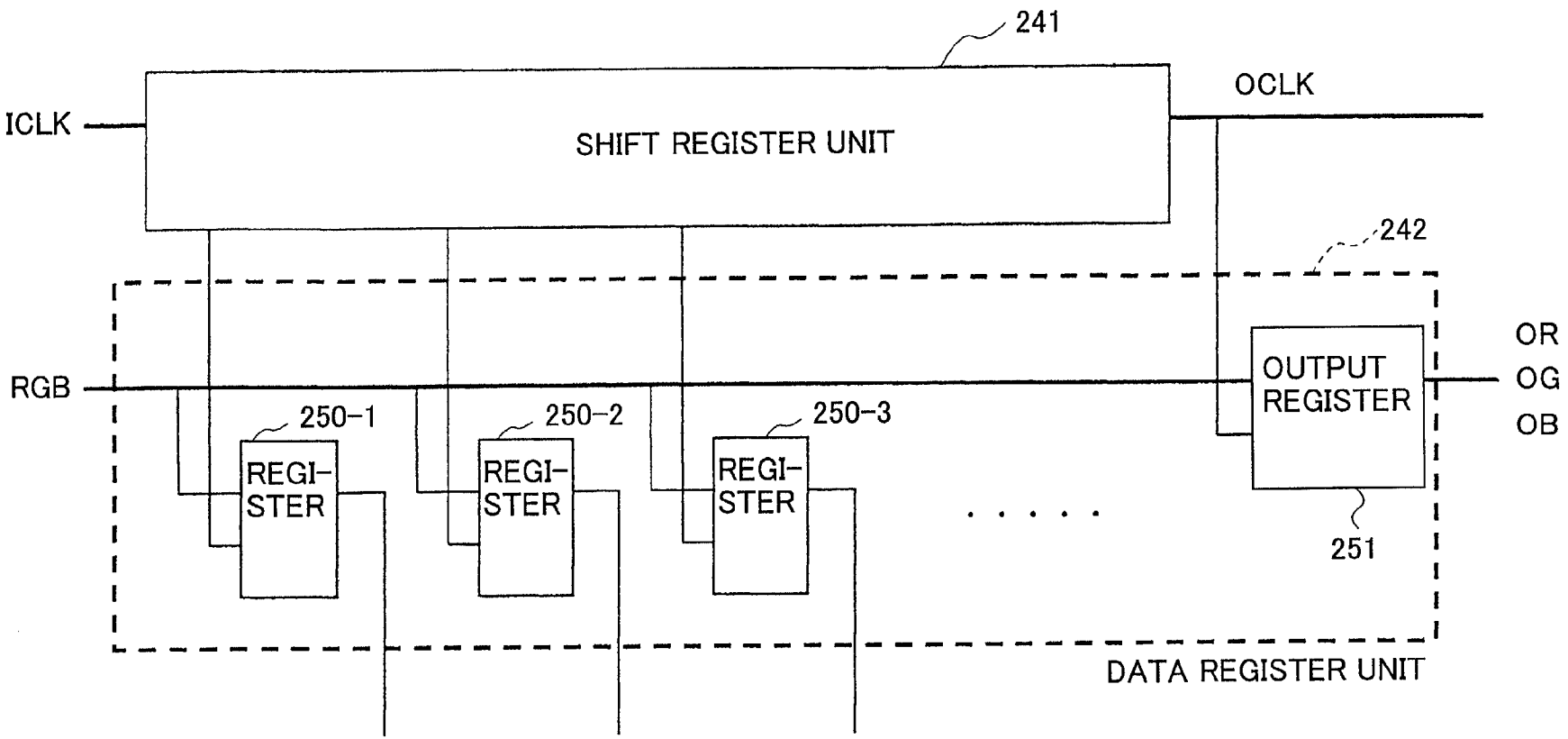
FIG. 19 is a drawing showing a first embodiment of a data register unit.

FIG. 19 is a drawing showing a first embodiment of the data register unit 242.

The data register unit 242 of FIG. 19 includes registers 250-1, 250-2, 250-3, and so on, and further includes an output register 251. The registers 250-1, 250-2, 250-3, and so on store therein the RGB display data in synchronization with the data latch signals supplied from the shift register unit 241 as the display data are successively supplied thereto. The output register 251 stores therein the display data RGB in synchronization with the output clock signal OCLK that is supplied from the shift register unit 241 to the next stage, thereby outputting the output display data OR, OG, and OB to the next stage in synchronization with the output clock signal OCLK.

Figure 20:
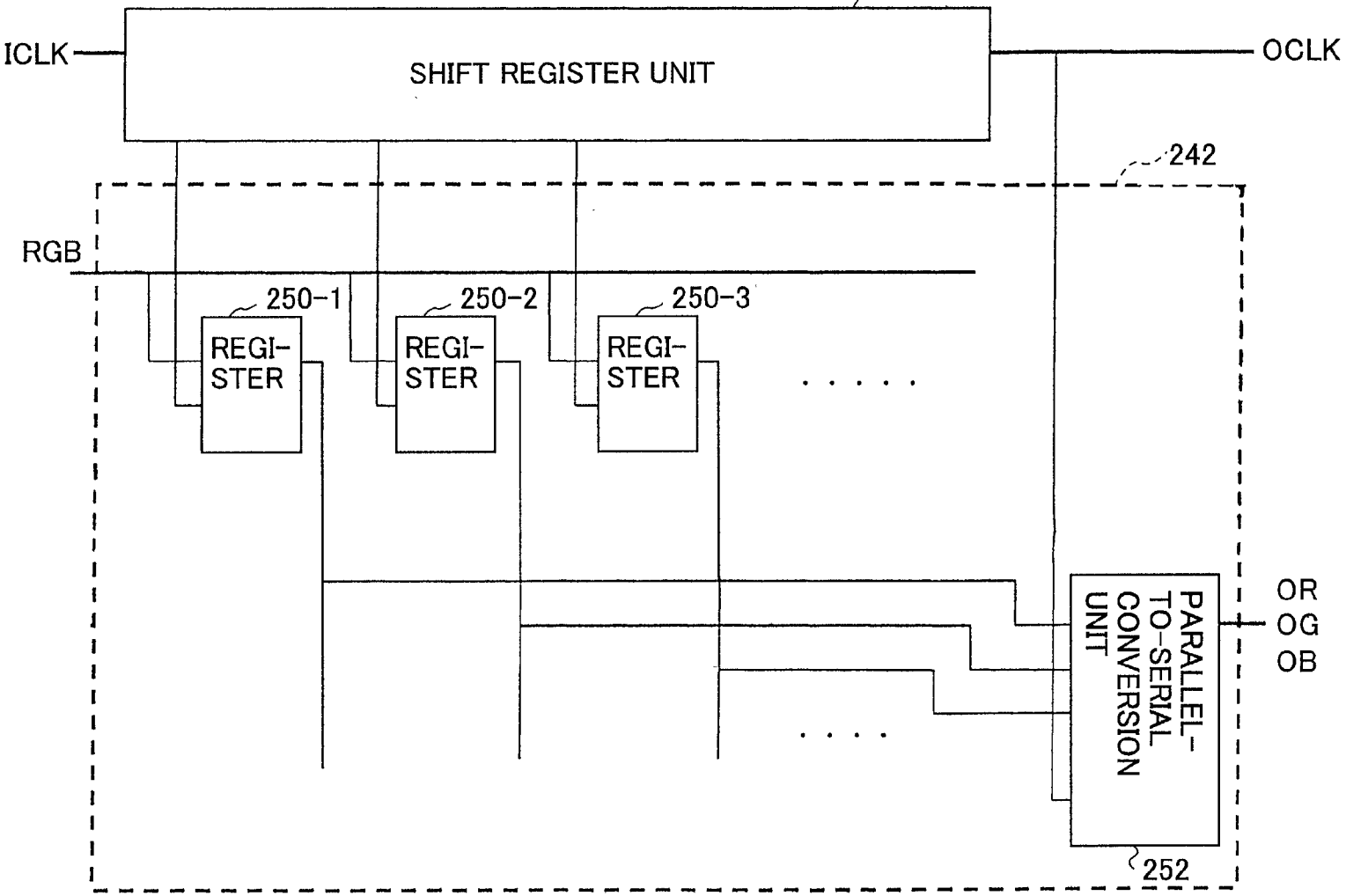
FIG. 20 is a drawing showing a second embodiment of the data register unit.

FIG. 20 is a drawing showing a second embodiment of the data register unit 242.

The data register unit 242 of FIG. 20 includes registers 250-1, 250-2, 250-3, and so on and a parallel-to-serial conversion unit 252. The parallel-to-serial conversion unit 252 converts the display data RGB from parallel data to serial data as the display data RGB are provided as parallel data from the registers 250-1, 250-2, 250-3, and so on, thereby supplying the serial data to the next stage as output display data OR, OG, and OB. In the configuration of FIG. 20, the parallel-to-serial conversion unit 252 may be provided in the latch unit 243 rather than in the data register unit 242.

In the above description, the output clock signal OCLK output from the shift register unit 241 may be the same signal as the input clock signal ICLK that is supplied to the shift register unit 241. Where there are intervening buffers or the like in the shift register unit 241, however, the output clock signal OCLK ends up having a different timing than the input clock signal ICLK. In such a case, the cascade signal output from the shift register unit 241 should be synchronized with the output clock signal OCLK.

Figure 21:
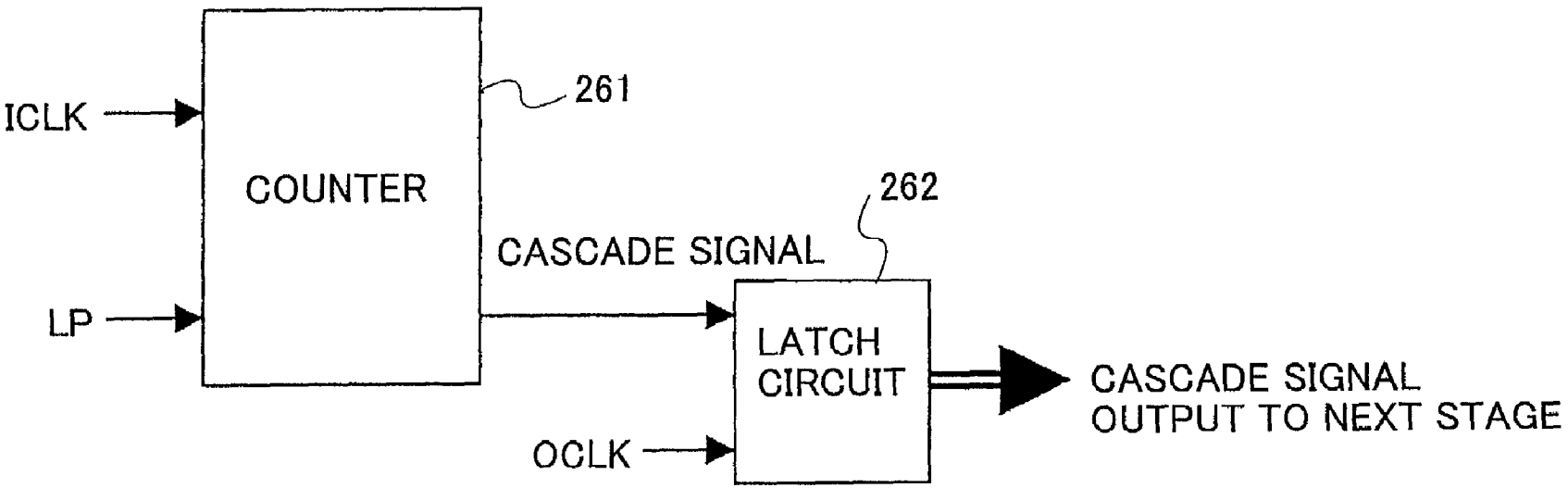
FIG. 21 is a drawing showing a configuration that synchronizes a cascade signal supplied to the next stage with an output clock signal in a shift register unit.

FIG. 21 is a drawing showing a configuration that synchronizes the cascade signal supplied to the next stage with the output clock signal in the shift register unit 241.

The configuration of FIG. 21 includes a counter 261 and a latch circuit 262. The counter 261 is reset by the latch pulse LP indicative of the output timing at which the data drivers output data, and, then, starts counting pulses of the input clock signal ICLK, followed by asserting the output thereof as the count reaches a predetermined number. This output is the related-art cascade signal that is output to the next stage. In the present invention, the cascade signal is latched by the latch circuit 262 in synchronization with the output clock signal OCLK. In this manner, the latch circuit 262 outputs the cascade signal to the next stage in synchronization with the output clock signal OCLK.

Figure 22:
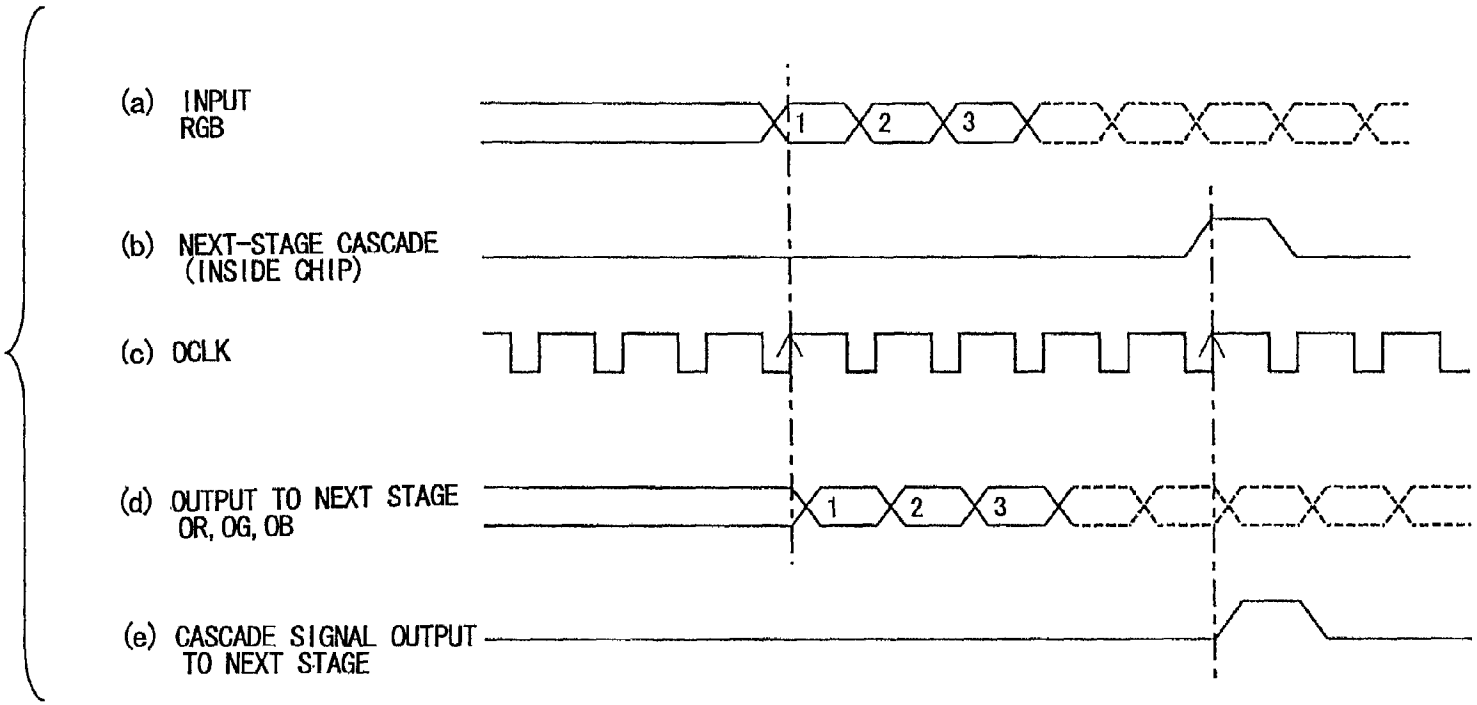
FIG. 22 is a timing chart showing the timing of display data and the cascade signal.

FIG. 22 is a timing chart showing the timing of display data and the cascade signal according to the present invention.

In FIG. 22, a letter designation (a) shows input display data signals RGB, and a letter designation (b) illustrates the cascade signal that is output from the counter 261 of FIG. 21. The input display data signals RGB are latched in synchronization with the output clock signal OCLK shown in FIG. 22-(*c*), so that the output display data signals OR, OG, and OB supplied to the next stage are obtained as shown in FIG. 22-(*d*). Further, the cascade signal shown in (b) is latched in synchronization with the output clock signal OCLK, so that the output cascade signal supplied to the next stage is obtained as shown in (e).

In this manner, the data driver according to the present invention outputs the display data signals and the cascade signal to the next stage in synchronization with the clock signal used inside the data driver. This makes it possible to drive the data drivers at proper timings regardless of delays and signal distortions that vary depending on the lengths of wires in the panel. The provision of wires inside a large-scale panel can thus be properly made.

Further, the present invention is not limited to these embodiments, but various variations and modifications may be made without departing from the scope of the present invention.

The present application is based on Japanese priority application No. 2001-360961 filed on Nov. 27, 2001, with the Japanese Patent Office, the entire contents of which are hereby incorporated by reference.

What is claimed is:

1. A circuit for driving a liquid crystal display panel, which is to be coupled to and supply display data to data bus lines of the liquid crystal display panel, comprising:

input nodes which receive the display data and a clock signal;

registers configured to store the display data as parallel data;

first output nodes which output the display data stored in said registers to the data bus lines;

a synchronizing circuit coupled to said registers to convert the display data stored in said registers into serial data synchronized with the clock signal; and a second output node which supplies the serial data synchronized with the clock signal by said synchronizing circuit to a circuit for driving the liquid crystal display panel provided at a next stage.

2. The circuit as claimed in claim 1, wherein said synchronizing circuit is a register circuit.

3. The circuit as claimed in claim 1, further comprising:

a register circuit which synchronizes a cascade signal with the clock signal; and a third output node which supplies the cascade signal synchronized with the clock signal by said register circuit to said circuit for driving the liquid crystal display panel provided at the next stage.

4. A liquid crystal display apparatus, comprising:

a liquid crystal display panel which includes data bus lines and gate bus lines;

a plurality of gate drivers which drive the gate bus lines; and a plurality of data drivers which drive the data bus lines, wherein the data drivers are connected in a cascade connection, and at least one of the data drivers includes:

input nodes which receive display data and a clock signal;

registers configured to store the display data as parallel data;

first output nodes which output the display data stored in said registers to the data bus lines;

a synchronizing circuit coupled to said registers to convert the display data stored in said registers into serial data synchronized with the clock signal; and a second output node which supplies the display data synchronized with the clock signal by said synchronizing circuit to a next one of the data drivers provided at a next stage.

5. The liquid crystal display apparatus as claimed in claim 4, wherein at least one of said data drivers includes:

a register circuit which synchronizes a cascade signal with the clock signal; and a third output node which supplies the cascade signal synchronized with the clock signal by said register circuit to a next one of the data drivers provided at a next stage.

* * * * *